US008159418B2

(12) United States Patent
Yang

(10) Patent No.: US 8,159,418 B2
(45) Date of Patent: Apr. 17, 2012

(54) PLASMA DISPLAY AND DRIVING METHOD THEREOF

(75) Inventor: Jin-Ho Yang, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1135 days.

(21) Appl. No.: 11/955,687

(22) Filed: Dec. 13, 2007

(65) Prior Publication Data

US 2008/0273021 A1 Nov. 6, 2008

(30) Foreign Application Priority Data

May 3, 2007 (KR) ..... 10-2007-0043137

(51) Int. Cl.
*G09G 3/28* (2006.01)

(52) U.S. Cl. ..... 345/60; 345/204

(58) Field of Classification Search ..... 345/60–72
See application file for complete search history.

(56) References Cited

U.S. PATENT DOCUMENTS

| | | | | |
|---|---|---|---|---|
| 3,786,279 | A * | 1/1974 | Wilson | 327/487 |
| 7,768,481 | B2 * | 8/2010 | Jung et al. | 345/68 |
| 2002/0054001 | A1 * | 5/2002 | Awamoto | 345/60 |
| 2005/0219153 | A1 * | 10/2005 | Kim et al. | 345/60 |
| 2006/0267876 | A1 * | 11/2006 | Jang et al. | 345/68 |
| 2006/0279487 | A1 * | 12/2006 | Lee et al. | 345/68 |
| 2007/0029942 | A1 * | 2/2007 | Jeong et al. | 315/169.4 |
| 2008/0143642 | A1 * | 6/2008 | Son | 345/60 |
| 2008/0158104 | A1 * | 7/2008 | Lee | 345/67 |
| 2008/0211789 | A1 * | 9/2008 | Son | 345/204 |
| 2008/0272704 | A1 * | 11/2008 | Yang | 315/169.4 |
| 2011/0043507 | A1 * | 2/2011 | Yang | 345/211 |

FOREIGN PATENT DOCUMENTS

| | | |
|---|---|---|
| JP | 2002-132208 | 5/2002 |
| JP | 2007-11193 | 1/2007 |
| KR | 2007-17706 | 2/2007 |

* cited by examiner

*Primary Examiner* — Seokyun Moon
(74) *Attorney, Agent, or Firm* — Christie, Parker & Hale, LLP

(57) ABSTRACT

A plasma display and a driving method thereof. The plasma display includes a plurality of first electrodes, a first switch, a second switch, a third switch, and a first capacitor. The first switch is connected between a first power source to supply a first voltage and the plurality of first electrodes. The second switch includes a first terminal electrically connected to the plurality of first electrodes, a second terminal connected to a second power source to supply a second voltage that is lower than the first voltage, and a gate connected to a signal input terminal. The third switch includes a first terminal electrically connected to the plurality of first electrodes, and a gate electrically connected to the first signal input terminal. The first capacitor includes a terminal connected to the second power source, and another terminal connected to a node of the first power source and a second terminal of the third switch.

16 Claims, 7 Drawing Sheets

PLASMA DISPLAY AND DRIVING METHOD THEREOF

CROSS-REFERENCE TO RELATED APPLICATION

This application claims the benefit of Korean Application No. 2007-43137, filed May 3, 2007, in the Korean Intellectual Property Office, the entire contents of which are incorporated herein by reference.

BACKGROUND OF THE INVENTION

1. Field of the Invention

Aspects of the present invention relate to a plasma display. More particularly, aspects of the present invention relate to a plasma display having low power consumption, and a driving method thereof.

2. Description of the Related Art

A plasma display is a flat panel display that uses plasma generated by gas discharge to display characters or images. A plasma display includes, depending on its size, more than several scores to millions of discharge cells (hereinafter, also referred to as "cells") arranged in a matrix pattern.

In general, on a panel of the plasma display, a frame is divided into a plurality of subfields, each having a weight. Gray scales are expressed during a display operation, by a combination of the weights of the subfields. Each subfield includes a reset period, an address period, and a sustain period. A wall charge of a discharge cell is initialized during the reset period, discharge cells are selected for emission during the address period, and a sustain discharge operation is performed in the emission cells, to display an image, during the sustain period.

Generally, in the plasma display, a voltage is decreased to initialize the wall charges of the discharge cells, during the reset period. In this case, a large amount of current flows to a switch that is used to decrease the voltage. The current generates heat in the switch, which can damage the switch. In addition, since a considerable power loss occurs when the voltage is decreased, a method for reducing the power loss is needed.

SUMMARY OF THE INVENTION

Aspects of the present invention provide a plasma display having low power consumption, and a driving method thereof. The plasma display, according to an exemplary embodiment of the present invention, includes a plurality of first electrodes, a first switch, a second switch, a third switch, and a first capacitor. The first switch is connected between a first power source, to supply a first voltage, and the plurality of first electrodes. The second switch includes a first terminal electrically connected to the plurality of first electrodes, a second terminal, connected to a second power source, to supply a second voltage that is lower than the first voltage, and a gate connected to a first signal input terminal. The third switch includes a first terminal electrically connected to the plurality of first electrodes, and a gate electrically connected to the first signal input terminal. The first capacitor includes a terminal connected to the second power source, and another terminal connected to a node of the first power source and a second terminal of the third switch. The first and second switches are turned on, during at least a part of a reset period, to gradually decrease a voltage of the plurality of first electrodes.

Aspects of the present invention relate to a driving method of a plasma display. The plasma display includes: a first switch connected between a first power source, to supply a first voltage, and a plurality of first electrodes; and a second switch connected between a second power source, to supply a second voltage that is lower than the first voltage, and the plurality of first electrodes. In the driving method, a voltage of the plurality of first electrodes is decreased from the first voltage to a third voltage, by simultaneously turning on the second switch and a third switch, during a first period of a reset period. The third switch includes a first terminal connected to the plurality of first electrodes, and a second terminal connected to the second power source. The voltage of the plurality of first electrodes is decreased from the third voltage to the second voltage, by turning on the second switch during a second period of the reset period. When the voltage of the plurality of first electrodes is decreased to the third voltage, voltage conducted through the third switch, during the first period, is charged to a first capacitor. The first capacitor includes a terminal connected to a node between the first power source and a second terminal of the third switch, and another terminal connected to the second power source.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, of which.

DETAILED DESCRIPTION OF THE EMBODIMENTS

Figure 1:
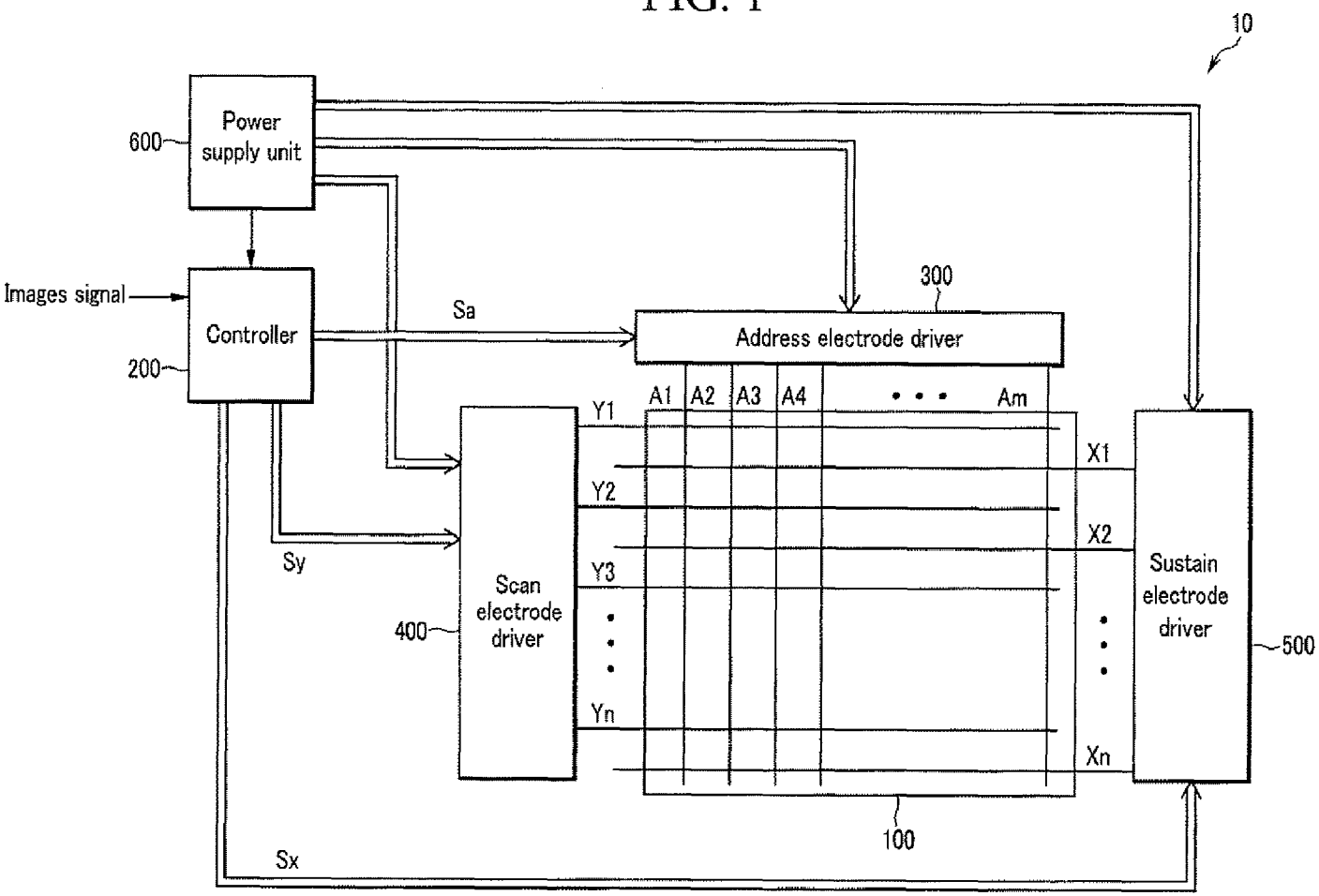
FIG. 1 is a block diagram of a plasma display, according to an exemplary embodiment of the present invention.

Reference will now be made in detail to the exemplary embodiments of the present invention, examples of which are illustrated in the accompanying drawings, wherein like reference numerals refer to the like elements throughout. The exemplary embodiments are described below, in order to explain the aspects of the present invention, by referring to the figures.

Throughout this specification and the claims that follow, when it is described that an element is "coupled" to another element, the element may be "directly coupled" to the other element, or may be "electrically coupled" to the other element through a third element. In addition, unless explicitly described to the contrary, the word "comprise" and variations thereof, such as "comprises", or "comprising", will be understood to imply the inclusion of stated elements, but not the exclusion of any other elements.

The wall charges referred to herein, are charges formed on a wall (e.g., a dielectric layer) close to each electrode of a discharge cell. The wall charges are described as being "formed" or "accumulated" on the electrode, although the wall charges do not actually touch the electrodes. Further, a wall voltage is referred to as a potential difference formed on the wall of the discharge cell, by the wall charges.

When the specification refers to a voltage that is maintained, it should not be understood to strictly imply that the voltage is maintained exactly at a predetermined voltage. To the contrary, even if a voltage difference between two points varies, the voltage difference is maintained at a predetermined voltage, in the case that the variance is within a range allowed in design constraints, or in the case that the variance is caused due to a parasitic component that is usually disregarded by a person of ordinary skill in the art. In addition, since threshold voltages of semiconductor elements (e.g., a transistor and a diode) are very low, as compared to a discharge voltage, they are considered to be 0V.

FIG. 1 is a block diagram of the plasma display 10, according to an exemplary embodiment of the present invention. As shown in FIG. 1, the plasma display 10 includes a plasma display panel (PDP) 100, a controller 200, an address electrode driver 300, a scan electrode driver 400, a sustain electrode driver 500, and a power supply unit 600.

The display panel 100 includes a plurality of address electrodes A1 to Am, extending in a column direction, and a plurality of sustain and scan electrodes X1 to Xn and Y1 to Yn, extending in pairs in a row direction. The sustain electrodes X1 to Xn are formed to correspond to the respective scan electrodes Y1 to Yn. Ends of the sustain electrodes X1 to Xn are coupled in common. The plasma display panel 100 includes a substrate (not shown) on which the sustain electrodes X1 to Xn and the scan electrodes Y1 to Yn are arranged, and a substrate (not shown) on which the address electrodes A1 to Am are arranged.

The two substrates are disposed to face each other, with discharge spaces interposed therebetween, such that the address electrodes A1 to Am cross the scan electrodes Y1 to Yn and the sustain electrodes X1 to Xn. In this case, discharge spaces, disposed at intersections of the address electrodes A1 to Am, the sustain electrodes X1 to Xn, and the scan electrodes Y1 to Yn, form discharge cells. The structure of the plasma display panel 100 is an illustrative example, and panels having different structures, to which the following driving waveforms can be applied, may be applied to the present invention.

The controller 200 receives a video signal from the outside, and outputs an address electrode driving control signal Sa, a sustain electrode driving control signal Sx, and a scan electrode driving control signal Sy. The controller 200 divides one frame into a plurality of subfields, and drives each of the subfields. Each of the subfields includes a reset period, an address period, and a sustain period, which are sequentially driven.

The address electrode driver 300 receives the address electrode driving control signal Sa from the controller 200, and applies display data signals, to select the discharge cells, to the individual address electrodes. The scan electrode driver 400 receives the scan electrode driving control signal Sy from the controller 200, and applies the driving voltage to the scan electrodes Y. The sustain electrode driver 500 receives the sustain electrode driving control signal Sx from the controller 200, and applies the driving voltage to the sustain electrodes X. The power supply 600 supplies voltages, used to drive the plasma display device 10, to the controller 200 and the drivers 300, 400, and 500.

Figure 2:
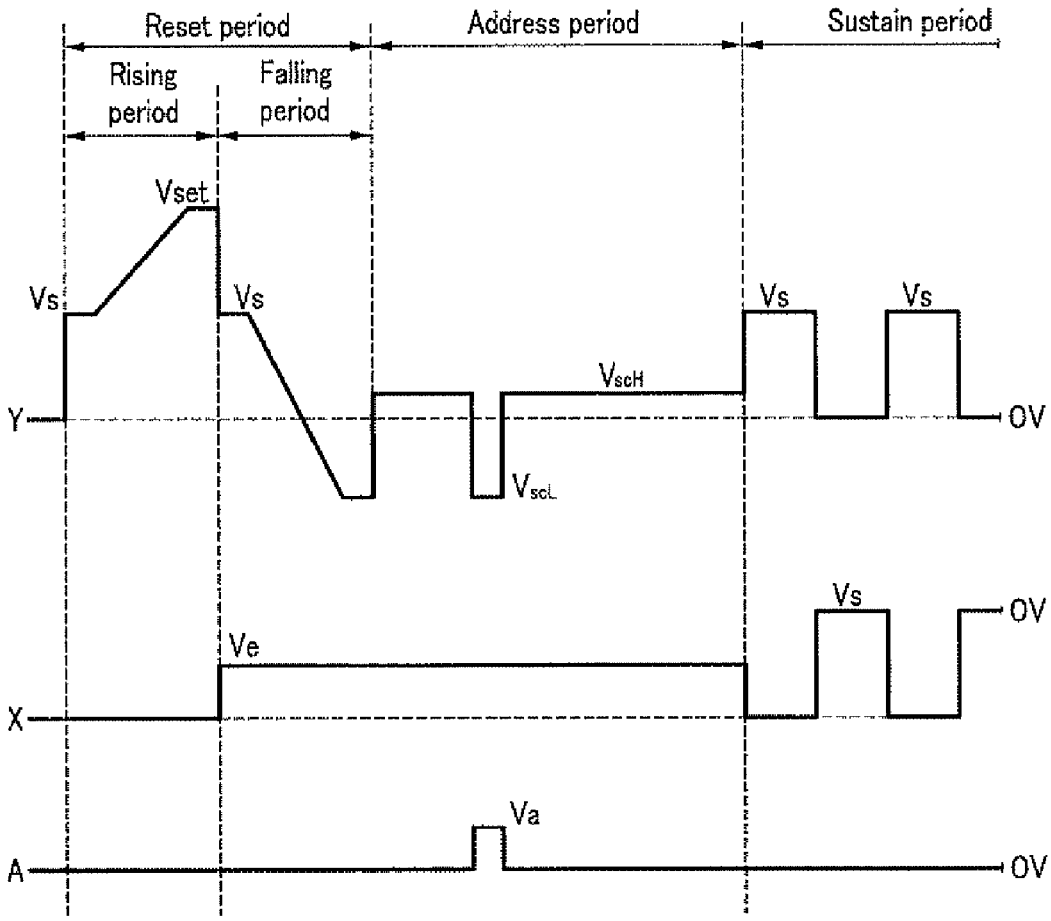
FIG. 2 is a diagram showing driving waveforms of the plasma display device, according to the exemplary embodiment of the present invention.

FIG. 2 is a diagram showing driving waveforms of the plasma display device 10. The driving waveforms of the plasma display device 10, shown in FIG. 2, show only one driving waveform within one subfield. One subfield of the plasma display panel 100 (see FIG. 1) includes a reset period, an address period, and a sustain period, depending on a variation in the input voltage to the sustain electrodes X, the scan electrodes Y, and the address electrodes A. The input voltage is controlled by the controller 200 (see FIG. 1).

The reset period has a rising period and a falling period. In the rising period, the address electrode A, and the sustain electrode X, are kept at a reference voltage (0V in FIG. 2), a voltage of the scan electrode Y is gradually increased, from a voltage Vs (sustain voltage) to a voltage Vset (a reset voltage). The increase in voltage of the scan electrode Y causes a weak discharge between the scan electrode Y and the sustain electrode X, and between the scan electrode Y and the address electrode A. Then, negative (−) wall charges are formed on the scan electrode Y, and positive (+) wall charges are formed on the sustain electrode X and the address electrode A. The sum of a wall voltage between the electrodes, caused by the wall charges when the voltage of the scan electrode Y reaches the voltage Vset, and an external voltage, is consistent with a discharge firing voltage Vf.

In the reset period, the cells are initialized. Accordingly, the voltage Vset is high enough, such that a discharge can occur in the cells. FIG. 2 shows a case where the voltage of the scan electrode Y increases, or decreases, in a ramp pattern. Alternatively, a different type of waveform that gradually increases, or decreases, may be applied.

In the falling period, while the address electrode A and the sustain electrode X are respectively maintained at the reference voltage and a voltage Ve, the voltage of the scan electrode Y is gradually decreased from the Vs voltage to a VscL voltage. The decrease in the voltage of the scan electrode Y causes a weak discharge between the scan electrode Y and the sustain electrode X, and between the scan electrode Y and the address electrode A. The (−) wall charges formed on the scan electrode Y, and the (+) wall charges formed on the sustain electrode X in the rising period, are erased. As a result, the (−) wall charges of the scan electrode Y, and the (+) wall charges of the sustain electrode X and the address electrode A, are decreased. In this case, the positive wall charges of the address electrode A are decreased to a level sufficient for an address operation.

In general, a voltage of (VscL-Ve) is set to be close to the discharge firing voltage Vf, between the scan electrodes Y and the sustain electrodes X. Accordingly, since a difference in wall voltage, between the scan electrode Y and the sustain electrode X, approximates 0V, cells in which the address discharge does not occur in the address period, are prevented from misfiring during the sustain period.

Since a large amount of current flows to a switch used to decrease the voltage of the scan electrode Y, in the falling period of the reset period, the switch may be damaged by heat generated by the current, and power loss may be increased when the voltage is increased. The scan electrode driver 400, according to the exemplary embodiment of the present invention, may reduce the amount of current flowing through the switch used in the falling period of the reset period, to reduce the power loss and/or the damage thereto, caused by the heat.

In FIG. 2 the reset period includes the rising period and the falling period, and the rising period of the reset period may be selectively provided to the respective subfields. That is, the rising period of the reset period may, or may not, be provided to the respective subfields.

In the address period, to select the light emitting cell, while the Ve voltage is applied to the sustain electrodes X1-Xn, a scan pulse having the VscL voltage (scan voltage) is sequentially applied to the plurality of scan electrodes Y1-Yn. Simultaneously, an address voltage is applied to the address electrodes A1-Am, passing through the light emitting cells, among the plurality of cells formed by the scan electrode, to which the VscL voltage is applied.

The address discharge is generated between the address electrodes A1-Am receiving the address voltage, and the scan electrodes Y1-Yn receiving the VscL voltage. The address discharge is also formed between the scan electrodes Y1-Yn receiving the VscL voltage, and the sustain electrodes X1-Xn corresponding to the scan electrodes Y1-Yn receiving the VscL voltage. The (+) wall charges are formed on the scan electrodes Y1-Yn, and the (−) wall charges are formed on the address electrodes A1-Am and the sustain electrodes X1-Xn. In addition, a VscH voltage (non-scan voltage), which is higher than the VscL voltage, is applied to the scan electrodes Y1-Yn to which the VscL voltage is not applied, and the reference voltage is applied to the address electrodes A1-Am of the discharge cells that are not selected.

In the sustain period, a sustain pulse, alternately having a high voltage (the Vs voltage in FIG. 2) and a low voltage (the 0V voltage in FIG. 2), is applied to the scan electrode Y and the sustain electrode X. In this case, the sustain pulse applied to the scan electrode Y, and the sustain pulse applied to the sustain electrode X, have opposite phases. Accordingly, the 0V voltage is applied to the sustain electrode X, when the Vs voltage is applied to the scan electrode Y; the 0V voltage is applied to the scan electrode Y, when the Vs voltage is applied to the sustain electrode X; and a discharge is generated between the scan and sustain electrodes Y and X, by a wall voltage formed between the scan and sustain electrodes Y and X, by the address discharge and the Vs voltage. Subsequently, the sustain pulse is repeatedly applied to the scan and sustain electrodes Y and X, a number of times corresponding to a weight value of the corresponding subfield.

Figure 3:
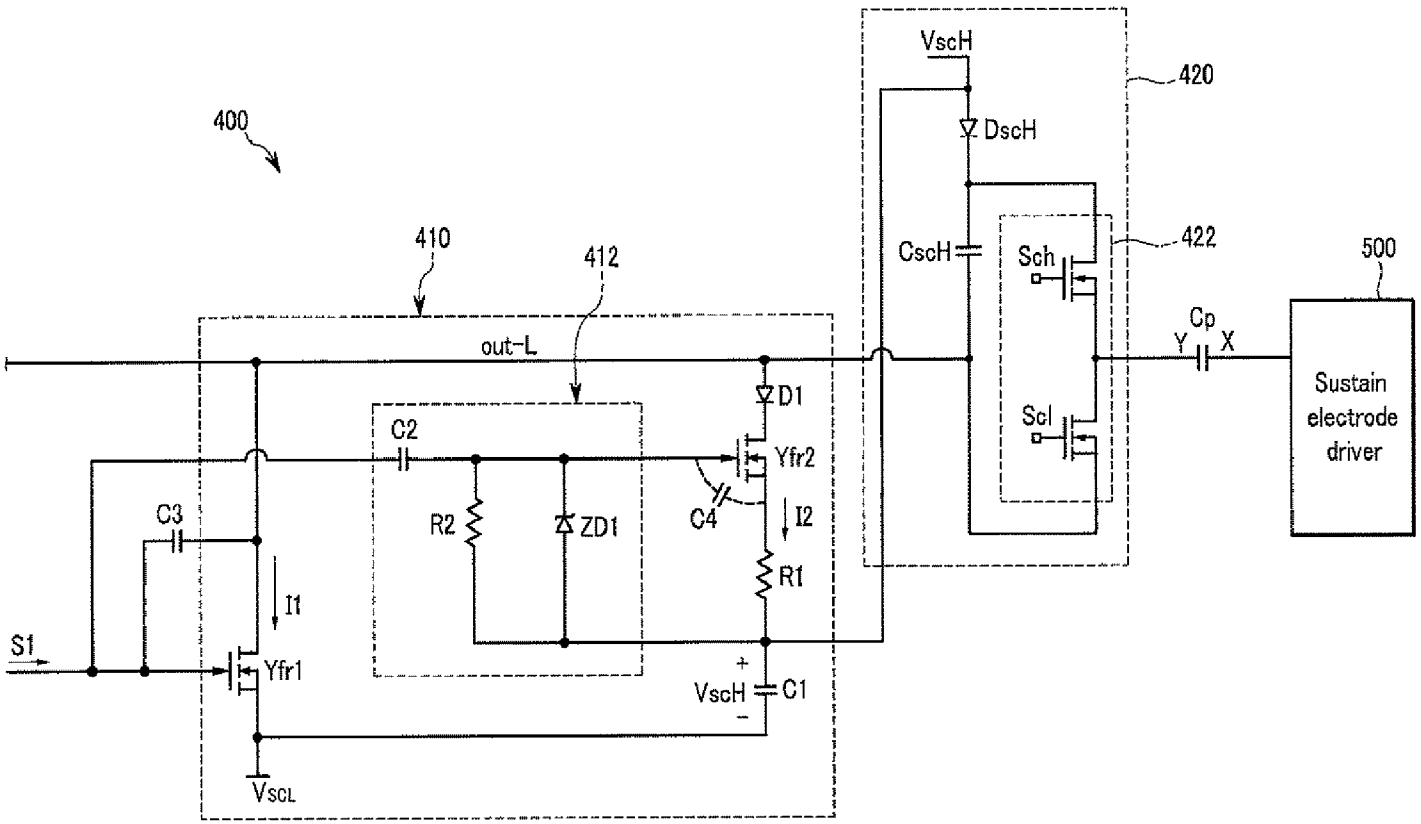
FIG. 3 is a diagram of a scan electrode driver, according to the exemplary embodiment of the present invention.

The scan electrode driver 400 will now be described with reference to FIG. 3. While the scan electrode driver 400 includes a plurality of driving elements, to produce the driving waveform of the plasma display 10, only elements to generate the driving waveform, of the falling period of the reset period, are shown in FIG. 3. In addition, in FIG. 3 a switch is illustrated as an n-channel field effect transistor (FET), having a body diode (not shown), however, other suitable switches, having a similar or the same function, may be used. Further, a capacitance formed by the sustain electrode X and the scan electrode Y, is illustrated as a panel capacitor Cp.

As shown in FIG. 3, the scan electrode driver 400 includes a VscL voltage supply unit 410 and a scan driver 420. The VscL voltage supply unit 410 includes a diode D1, transistors Yfr1 and Yfr2, capacitors C1 and C3, a resistor R1, and a level shift unit 412.

The transistor Yfr1 includes a drain connected to an Out-L line, and a source connected to a power source VscL, to supply the VscL voltage. The capacitor C3 is connected between a drain and a gate of the transistor Yfr1. The diode D1 includes an anode connected to the Out-L line. A drain of the transistor Yfr2 is connected to a cathode of the diode D1. A terminal of the resistor R1 is connected to the source of the transistor Yfr2. A terminal of the capacitor C1 is connected to another terminal of the resistor R1. Another terminal of the capacitor C1 is connected to the source of the transistor Yfr1. The capacitor C1 is charged with the VscH voltage, and the transistors Yfr1 and Yfr2 are simultaneously turned on/off, by a control signal S1, supplied from the controller 200, shown in FIG. 1.

The capacitor C3 decreases the voltage of the scan electrode Y, from the Vset voltage to the VscL voltage, in a ramp-type waveform. That is, the capacitor C3 turns off the transistor Yfr1, when a voltage between the gate and the drain of the transistor Yfr1 rapidly increases, and the capacitor C3 increases the amount of current flowing through the transistor Yfr1, when the voltage between the gate and the drain of the transistor Yfr1 is maintained within a predetermined range. Accordingly, the transistor Yfr1 operates as a voltage controlling transistor, which is controlled according to the voltage between the gate and the drain.

When the amount of current flowing through the transistor Yfr2 increases, the resistor R1, connected to the source of the transistor Yfr2, decreases the voltage between the gate and the source of the transistor Yfr2, to prevent the current flowing through the transistor Yfr2 from exceeding a predetermined level. That is, the transistor Yfr2 operates as a constant current switch. The diode D1 prevents the current from flowing in a direction from the transistor Yfr2 to the Out-L line, through the body diode of the transistor Yfr2. Therefore, the diode D1 can be placed at different positions from FIG. 3. For example, the diode D1 can includes an anode connected to the source of the transistor Yfr2, and a cathode connected to a resistor R1. Furthermore, the diode D1 can include an anode connected to a resistor R1, and a cathode connected to a capacitor C1.

The level shift unit 412 includes a capacitor C2, a resistor R2, and a Zener diode ZD1. A terminal of the capacitor C2 is connected to an input terminal, which receives the control signal S1 from the controller 200, shown in FIG. 1. Another terminal of the capacitor C2 is connected to a gate of the transistor Yfr2. A terminal of the resistor R2 is connected to the other terminal of the capacitor C2. Another terminal of the resistor R2 is connected to a node of the resistor R1 and the capacitor C1 The Zener diode ZD1 includes a cathode connected to a node of the capacitor C2 and the resistor R2, and an anode connected to the other terminal of the resistor R2. Here, the capacitor C2 has a capacity that is greater than a parasitic capacitance C4, disposed between the gate and the source of the transistor Yfr2. Accordingly, since the control signal S1, applied to the terminal of the capacitor C2, is directly provided to the gate of the transistor Yfr2, the transistor Yfr2 and the transistor Yfr1 may be simultaneously turned on.

The VscL voltage supply unit 410 includes the diode D1, the transistor Yfr2, the capacitor C1, the resistor R1, the level shift unit 412, and is connected to a conventional VscL voltage supply unit. Accordingly, the scan electrode driver 400 may reduce the damage and/or the power loss, caused by the heat, as compared to a conventional scan electrode driver, which generates a failing reset pulse by using only one transistor Yfr1.

The scan driver 420 includes a diode DscH, a capacitor CscH, and a selection circuit 422. An anode of the diode DscH is connected to a node of a power source VscH (to supply the VscH voltage) and the capacitor C1. A terminal of the capacitor CscH is connected to a cathode of the diode DscH, and another terminal of the Out-L line.

The selection circuit 422 includes transistors Sch and Scl. A drain of the transistor Sch is connected to a node of the diode DscH and to the capacitor CscH. A source of the transistor Sch is connected to the scan electrode Y. A drain of the transistor Scl is connected to the scan electrode Y. A source of the transistor Scl is connected to the other terminal of the capacitor CscH. The selection circuit 422 applies the VscL voltage to the scan electrodes Y1-Yn, to select discharge cells for emission, during the address period. The selection circuit 422 applies the VscH voltage, supplied from the capacitor C1, to the scan electrode Y of non-selected (non-emitting) discharge cells. Generally, the selection circuit 422 is connected to each of the scan electrodes Y1 to Yn, as an integrated circuit (IC), to sequentially select the scan electrodes Y1 to Yn, during the address period. A driving circuit (not shown) of the scan electrode driver 400 is connected to the scan electrodes Y1 to Yn in common, through the selection circuit 422. In FIG. 3, only one selection circuit 422, corresponding to one scan electrode Y, is illustrated.

Figure 4A:
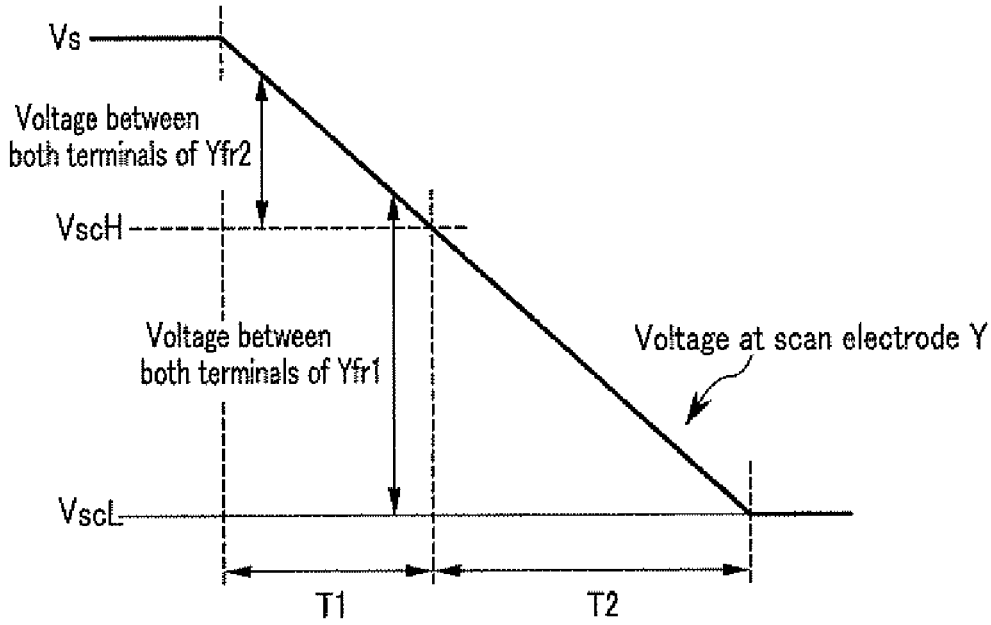
FIG. 4A is a diagram representing a voltage variation of a scan electrode Y, during a falling period of a reset period.
Figure 4B:
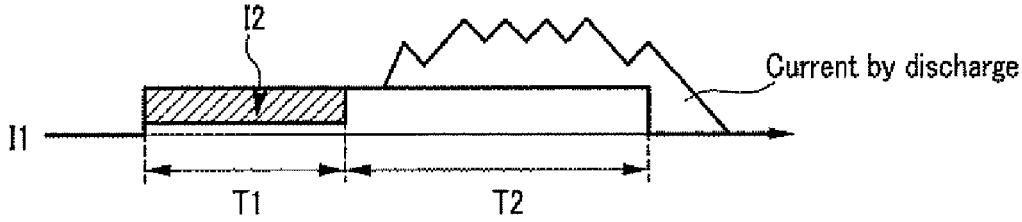
FIG. 4B is a diagram representing an amount current flowing through transistors Yfr1 and Yfr1 , during the falling period of the reset period.
Figure 4C:
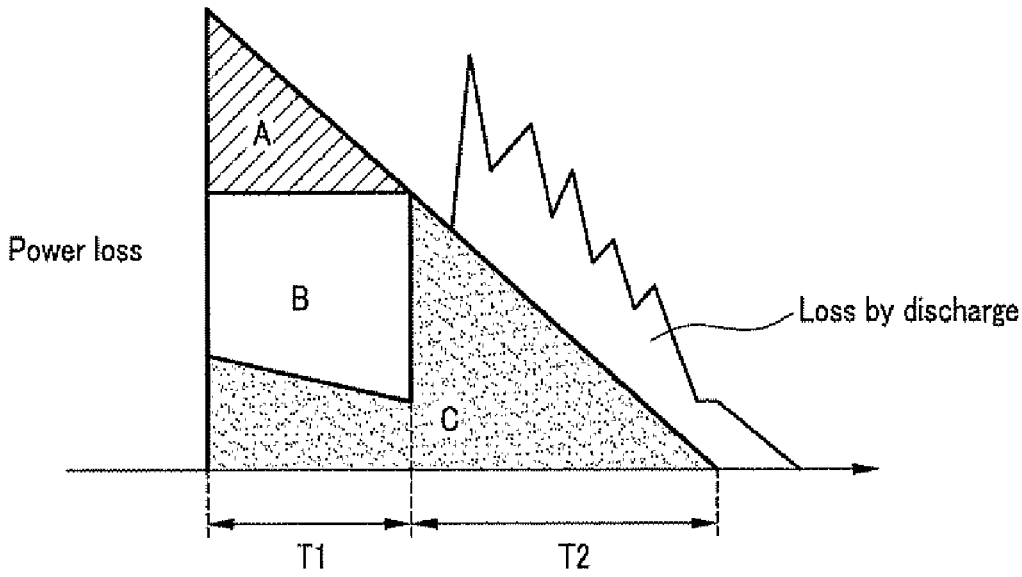
FIG. 4C is a diagram representing power loss during the falling period of the reset period.
Figure 5:
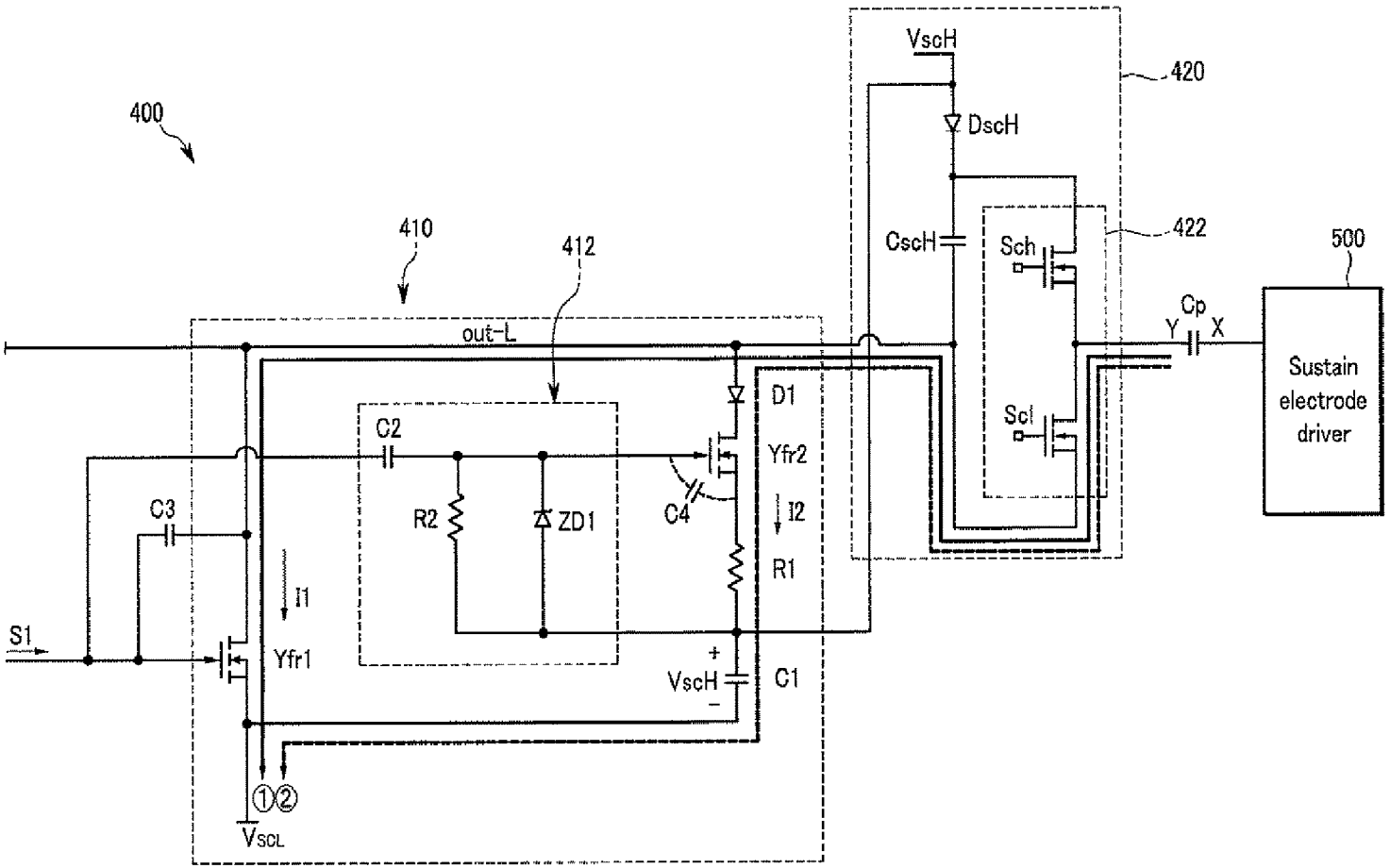
FIG. 5 is a diagram representing first and second current paths (1) and (2), to realize the driving waveform of the falling period of the reset period, among the driving waveforms of the plasma display shown in FIG. 2, by using the scan electrode driver, according to the exemplary embodiment of the present invention.

An operation of the scan electrode driver 400, according to an exemplary embodiment of the present invention, will now be described with reference to FIGS. 4A-4C and FIG. 5. FIG. 4A is a diagram representing a voltage variation of the scan electrode Y, during the falling period of the reset period, and FIG. 4B is a diagram representing the amount of current flowing through the transistors Yfr1 and Yfr2, during the falling period of the reset period. FIG. 4C is a diagram representing the power loss during the falling period of the reset period. FIG. 5 is a diagram representing first and second current paths ① and ②, to produce the driving waveform of the falling period of the reset period, among the driving waveforms of the plasma display 10, by using the scan electrode driver 400.

In FIG. 4B, I1 and I2 respectively denote currents flowing through the transistor Yfr1 and the transistor Yfr2. In addition, in FIG. 4C, an area A denotes the power loss caused by the transistor Yfr2, and an area C denotes the power loss caused by the transistor Yfr1. Further, an area B denotes the amount of power charged in the capacitor C1. Here, it is assumed that the Vs voltage has been applied to the scan electrode Y, before a period T1.

During the period T1, the transistors Yfr1 and Yfr2 are continuously turned on. At a starting point of the period T1, the transistors Yfr1 and Yfr2 are turned on, according to the control signal S1 applied from the controller 200, shown in FIG. 1. At this time, the transistor Scl is turned on. Since the transistor Yfr1 is turned on, current flows through a first current path ①, which extends between the scan electrode Y, the transistor Scl, and the transistor Yfr1, and the power source VscL. In addition, since the transistor Yfr2 is turned on, current flows through a second current path ②, which extends between the scan electrode Y, the transistor Scl, the diode D1, the transistor Yfr2, the resistor R1, the capacitor C1, and the power source VscL.

That is, the currents simultaneously flow from the scan electrode Y to the power source VscL, through the two current paths (i.e., the first and second current paths ① and ②). Therefore, the voltage of the scan electrode Y gradually decreases from the Vs voltage. Since the current flows through the second current path ②, the capacitor C1 is charged.

At the starting point of the period T1, a voltage difference between the drain and the source of the transistor Yfr1 is large, as shown in FIG. 4A. The scan electrode driver 400 simultaneously turns on the two transistors Yfr1 and Yfr2, to divide the current flow between the first and second current paths ① and ②. Accordingly, the amount of current flowing through the transistor Yfr1 is reduced, to prevent heat damage to the transistor Yfr1. In addition, since the amount of current flowing through the transistor Yfr1 is reduced, the power loss during the rising period of the reset period may be greatly reduced. That is, as shown in FIG. 4C, when the rising reset pulse is generated by using only one transistor Yfr1, the amount of power conducted through the transistor Yfr1 is can equal the sum of the areas A, B, and C. However, since the scan electrode driver 400 divides the current flow between the transistors Yfr1 and Yfr2, the power consumption of the transistor Yfr1 and the transistor Yfr2 are respectively the area C and the area A, and the power corresponding to the area B is charged in the capacitor C1. Accordingly, the scan electrode driver 400 may have considerably reduced power consumption, as compared to the conventional scan electrode driver using only one transistor Yfr1.

FIG. 4B and FIG. 4C show a variation of the amount of current flowing through the transistor Yfr1 and a power loss caused by a weak discharge. During the period T2, the voltage of the scan electrode Y decreases from the VscH voltage to the VscL voltage. When the voltage of the scan electrode Y reaches the VscH voltage, the transistor Yfr2 is turned off, and therefore, the current flows through the transistor Yfr1, as shown in FIG. 4B. In addition, as shown in FIG. 4C, the current is consumed in the transistor Yfr1. During the period T2, since the voltage of the scan electrode Y decreases, a weak discharge is generated between the scan electrode Y and the sustain electrode X, and between the scan electrode Y and the address electrode A. In addition, when the voltage of the scan electrode Y reaches the VscL voltage, the transistor Yfr1 is turned off.

Since the scan electrode driver 400 turns on the transistor Yfr2, during the early rising period of the reset period, in which the voltage difference between both terminals of the transistor Yfr1 is great, so as to simultaneously flow the current through the two transistors Yfr1 and Yfr2, during the period T1. Therefore, the power consumption may be considerably reduced, and the circuit element may be prevented from being damaged by the heat. In addition, since the capacitor C1 is charged through the second current path ②, during the period T2, the voltage supplied from the power source VscH may be reduced, and the power consumption may be further reduced.

According to the exemplary embodiment of the present invention, since an erroneous operation, or damage of the switch caused by heat, may be prevented, and power consumption may be reduced, a plasma display operating by a low power may be realized.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A plasma display comprising:

electrodes to produce a discharge;

a selection circuit connected between a first power source to supply a first voltage, and the electrodes;

a first switch comprising a drain connected to the electrodes, via the selection circuit, a source connected to a second power source to supply a second voltage that is lower than the first voltage, and a gate connected to a signal input terminal;

a second switch comprising a drain connected to the electrodes, via the selection circuit, and a gate electrically connected to the signal input terminal, via a level shift unit;

a first capacitor comprising a first terminal connected to the second power source, and a second terminal connected to a first node between the first power source, the level shift unit, and a source of the second switch; and a first resistor coupled between the source of the second switch and the second terminal of the first capacitor, and configured to reduce a current flow through the second switch to below a predetermined current level that would result in damage to the first switch, wherein the first and second switches are simultaneously turned on, during at least a part of a reset period, to gradually decrease a voltage of the electrodes, and wherein a current flow of less than the predetermined current level is produced when the second switch is turned on.

2. The plasma display of claim 1, wherein a voltage difference between the source and the drain of the first switch is gradually decreased, when the first switch is turned on.

3. The plasma display of claim 2, further comprising a second capacitor connected between the drain of the first switch and the gate of the first switch, to gradually decrease the voltage difference.

4. The plasma display of claim 1, wherein the level shift unit turns on the second switch, when the first switch is turned on, and is connected between the signal input terminal and the gate of the second switch.

5. The plasma display of claim 4, wherein the level shift unit comprises:

a third capacitor comprising a first terminal connected to the signal input terminal, and a second terminal connected to the gate of the second switch;

a Zener diode connected having an anode connected to the first node, and a cathode connected to a second node between the first terminal of the third capacitor and the gate of the second switch; and a second resistor connected in parallel to the Zener diode.

6. The plasma display of claim 5, further comprising a diode comprising an anode electrically connected to the electrodes, via the selection circuit, and a cathode connected to the drain of the second switch.

7. The plasma display of claim 5, further comprising a diode comprising an anode connected to the source of the second switch, and a cathode connected to a terminal of the first resistor.

8. The plasma display of claim 5, further comprising a diode comprising an anode connected to a terminal of the first resistor, and a cathode connected to the second terminal of the first capacitor.

9. The plasma display of claim 5, wherein the first voltage is a non-scan voltage, and the second voltage is a scan voltage that is sequentially applied to the electrodes, during an address period.

10. A driving method of a plasma display comprising electrodes to produce a discharge; a first power source to supply a first voltage to the electrodes; a second power source to supply a second voltage that is lower than the first voltage, to the electrodes; a selection circuit connected between the first power source and the electrodes; a first switch connected comprising a source connected to the second power source, and a drain connected to the electrodes, via the selection circuit; a second switch comprising a drain connected to the electrodes, via the selection circuit, and a source connected to the second power source, via a capacitor, the capacitor comprising a first terminal connected to a node between the first power source, the second switch, and the source of the second switch, and the capacitor comprising a second terminal connected to the second power source, the driving method comprising:

during a first period of a falling period of a reset period, decreasing a voltage of the electrodes from the first voltage to a third voltage, by simultaneously turning on the first switch and the second switch; and during a second period of the falling period, decreasing the voltage of the electrodes from the third voltage to the second voltage, by turning off the second switch, wherein the decreasing of the voltage of the electrodes to the third voltage comprises charging the capacitor using a current conducted through the second switch.

11. The method of claim 10, wherein the first voltage is a sustain voltage, the second voltage is a scan voltage that is sequentially applied to the electrodes during an address period, and the third voltage is non-scan voltage.

12. The method of claim 10, wherein the turning on of the first switch and the second switch comprises dividing a current from the electrodes between first and second current paths connected to the second power source.

13. The method of claim 12, wherein the first current path connects the electrodes to the selection circuit, the selection circuit to the first switch, and the first switch to the second power source, and wherein the second current path connects the electrodes to the selection circuit, the selection circuit to the second switch, the second switch to the capacitor, and the capacitor to the second power source.

14. The plasma display of claim 1, wherein the electrodes are scan electrodes.

15. The plasma display of claim 1, wherein the first voltage is a non-scan voltage, and the second voltage is a scan voltage that is sequentially applied to the electrodes during an address period.

16. The plasma display of claim 1, further comprising:

a first current path to connect the electrodes to the selection circuit, the selection circuit the first switch, and the first switch to the second power source, and a second current path to connect the electrodes to the selection circuit, the selection circuit the second switch, the second switch to the capacitor, and the capacitor to the second power source, wherein current flows down the first and second current paths when the first and second switches are both turned on.

* * * * *